US005247882A

United States Patent [19]

Zook et al.

[11] Patent Number: 5,247,882

[45] Date of Patent: Sep. 28, 1993

[54] QUICK CHANGE ROTARY SCREEN PRINTING APPARATUS

[75] Inventors: Jon C. Zook, Carmel, Calif.; Robert A. Bourgeois, Orland Park, Ill.; Randy C. Lange, Pacific Grove; Charles E. Harriman, Marina, both of Calif.

[73] Assignee: Illinois Tool Works Inc., Glenview, Ill.

[21] Appl. No.: 698,310

[22] Filed: May 10, 1991

[51] Int. Cl.[5] ..... B41L 13/06

[52] U.S. Cl. ..... 101/120; 101/127.1

[58] Field of Search ..... 101/116, 117, 118, 119, 101/120, 127.1, 128.1

[56] References Cited

U.S. PATENT DOCUMENTS

| | | | |
|---|---|---|---|
| 2,928,340 | 3/1960 | Stein et al. | 101/120 |
| 3,685,442 | 8/1972 | Harwell, Jr. | 101/119 |
| 3,834,307 | 9/1974 | Zimmer | 101/119 |
| 3,886,861 | 6/1975 | Anselrode | 101/120 |
| 3,901,146 | 8/1975 | Stierlein | 101/120 |
| 4,070,964 | 1/1978 | Vertegaal | 101/120 |
| 4,905,591 | 3/1990 | van Mondfrans et al. | 101/120 |

*Primary Examiner*—Clifford D. Crowder
*Assistant Examiner*—Stephen R. Funk
*Attorney, Agent, or Firm*—Schwartz & Weinrieb

[57] ABSTRACT

The rotary screen printing apparatus is designed for ease of operation including adjustments and changes. A pivoting mounting frame mounts the print screen roll which may be easily withdrawn from one side of the roll by use of a bayonet fitting and removable bearing race and frame.

7 Claims, 5 Drawing Sheets

QUICK CHANGE ROTARY SCREEN PRINTING APPARATUS

FIELD OF THE INVENTION

BACKGROUND OF THE INVENTION

Adhesive screen printers are well known in the art for the application of various patterns of hot melt adhesive. Such printers are typified in U.S. Pat. Nos. 4,627,345 and 4,693,179, the contents of which are hereby incorporated by reference. Such machines are sold under the trademark MICROPRINT® by the assignee of the instant invention.

Such devices have in the past tended to be less than totally desirable for a number of reasons. First of all, utilization of such a device in combination with a traditional press requires cutting the press apart between the last print station and the first die cut station. This involves substantial expense and effort and causes substantial concern over the integrity of the equipment after rejoining. This problem is due to the use by all of such manufacturers of such equipment (rotary screen printers) of the three o'clock print position, that is, the print screen roll and the impression roll are located horizontally side by side.

Such devices further suffered from being hard to adjust and set up as well as being difficult to re-configure in the event that it is desired to use a different type screen or the like. Such devices further are not designed for easy screen changes and the like.

Such earlier devices are also difficult if not impossible to reverse printing direction without substantial reconfiguration and rebuilding.

OBJECTS OF THE INVENTION

It is therefore an object of this invention to provide a screen printing machine which is capable of quick and simple screen changes including change of screen size.

It is further an object of this invention to provide a machine which has high repeatability and ease of adjustability to provide an attractive operator environment.

It is yet further an object of this assembly to provide a machine which allows easy change of screen assemblies from the end rings.

It is further an object of this invention to provide a machine which has an overall configuration capable of being inserted into a typical press without the need to cut apart or otherwise drastically re-configure the press.

It is further an object of this invention to provide a machine which may be plumbed so as to pipe away fumes with a minimum of additional hardware.

It is yet another object of this invention to provide a machine which capably applies hot melt adhesive along with the ability to apply ambients and inks.

It is further an object of this invention to provide a screen printing apparatus which allows the operator to easily adjust the registration of the printing pattern with the web either electronically or through mechanical means.

It is further an object of this invention to provide a screen printing apparatus which maintains the point of tangency between print roll, impression roll and pressure bar without adjustment even when print screen size is changed.

It is further an object of this invention to provide a machine which is capable of printing a hot melt pattern onto an impression roll and thence transferring it to a substrate which may be heat sensitive and is not capable of direct printing or application.

SUMMARY OF THE INVENTION

A print screen is affixed to two end rings as is generally known in the prior art but rather than use a simple clamp ring or an adhesive or other bonding technology as known in the prior art, the end ring of the cylindrical screen is clamped to the end rings using cylindrical clamps which in addition utilizes a tongue and groove construction to further effectively clamp the screen between the end ring and the clamping ring allowing more axial tension to be applied to the screen.

On a typical press such as that manufactured by Mark Andy, there is a space between the final print station and the first die cut station. Screen printing apparatus such as those of the aforementioned prior art patents have typically been installed in such presses by literally cutting the press apart and inserting the screen printing apparatus in a lengthened space between the two stations. The space required in prior art stations has resulted because the print screen and impression cylinders contact one another at a 3 o'clock position, that is, the rotational axes of the two cylinders form a generally horizontal plane.

In the instant invention however, the impression and print cylinders are located nearly vertically above one another to provide a 5 o'clock print station thereby allowing the unit to be located in a much more compact space which in turn may be placed between the aforementioned stations on the printing press without the need to section or otherwise drastically reconstruct the press.

The instant invention is further designed for ease of application and use in that all the rollers necessary for various web paths are incorporated into the frame for forward and reverse feed. Pacing, nip and spreading rollers further assist web handling.

The instant invention is provided with a frame which is formed primarily of two large generally rectangular end plates having a number of cross bars and rollers located therebetween. A combination hood and heater cover the top of the space between the two side frame plates and portions of the front and back cover the print screen. This in turn provides a chamber which is nearly sealed to the outside and fumes which may accumulate therein may be easily evacuated by plumbing a hose and/or fan to that space. The ability to evacuate such fumes is of increasing importance due to environmental concerns.

The instant invention is designed for ease of operation and quick setup change and, towards that end, a mounting frame is pivotably mounted between the two main frame side plates. The mounting member upon which the mounting frame is located has an eccentric mounting point therein for mounting of the pressure bar pivot arm. Use of this eccentric mounting point allows the mounting member to be rotated thereby allowing the desired point of tangency to be maintained between the print screen, the impression cylinder and the pressure bar. This is an initial adjustment only, that is, it only need be accomplished when the machine is first set up with a given screen size. By offsetting the pivot point for the pressure bar from that of the mounting frame for the print roll, the point of tangency will be maintained even when print rolls of a different diameter are utilized.

The two side plates of the mounting frame are each provided with a fixed outer race having a tapered needle bearing and an inner race of which is removable and which bolts to the end of the print cylinder at the outboard or operator end and is attached at its inboard end to the inner race via a bayonet mounting.

Thus, when it is desired to change the screen, the pressure bar is swung upwardly via air cylinders and disconnected at its outboard end from its mounting bar which is then swung out of the way. The operator then unbolts the inner bearing race assembly from the outboard end of the print screen which is then detached from the bayonet mounting at the inboard end and withdrawn from the machine where it may then be changed. The mounting frame is swung upwardly so that the print screen no longer contacts the impression cylinder, and the gear drive is also disengaged from the print screen.

When it is desired to register the pattern provided by the screen printing apparatus with the web to which it is being applied, this may be accomplished in one of two ways. First of all, the mechanical positioning of the web relative to the print cylinder may be varied by operation of a pair of parallel rollers which rotate about an axis and serve to increase or decrease the length of the web path thereby causing the relative position of the web and print cylinder to change.

Re-registration may also be accomplished by electronically sensing the position of the web as well as sensing the position of the print cylinder and engaging the clutch driving the print cylinder at the desired position for appropriate registration.

Also, the device of the instant invention may be utilized to provide an indirect printing process whereby substrates which are not suitable for direct hot melt application may have a pattern printed thereon indirectly, similar to the offset process. A release coating is provided on the impression roll and typically utilizes silicone rubber. The pattern is printed on the impression roll whereupon it cools to a significant extent during partial rotation of the impression roll. Then, due to the release coating, the pattern on the impression roll transfers to the desired substrate upon application of pressure by a nip roll.

The frame and machine are also arranged to adjust the height of the mounting frame and pressure bar solely from the outboard or operator's position thereby aiding ease of operation.

Use of interchangeable standard pitch gears and the pivoting mounting frame allows the repeat length to be changed without any other adjustment by allowing the pattern to be skidded or slipped on the substrate.

BRIEF DESCRIPTION OF THE DRAWINGS

These and other objects and advantages of the invention will appear more fully from the following description made in conjunction with the accompanying drawings wherein like reference characters refer to the same or similar parts throughout the several views, and wherein.

DESCRIPTION OF THE PREFERRED EMBODIMENT

Figure 1A:
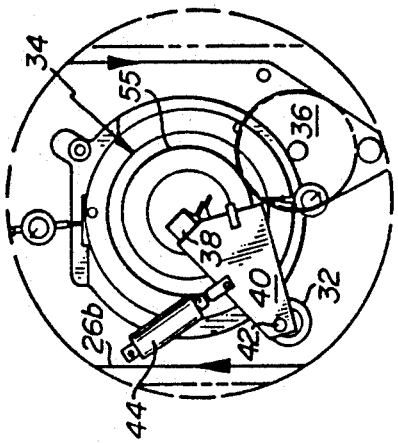
FIG. 1 is a side view showing the instant invention installed in a press from the outboard or operator's end.
Figure 1:
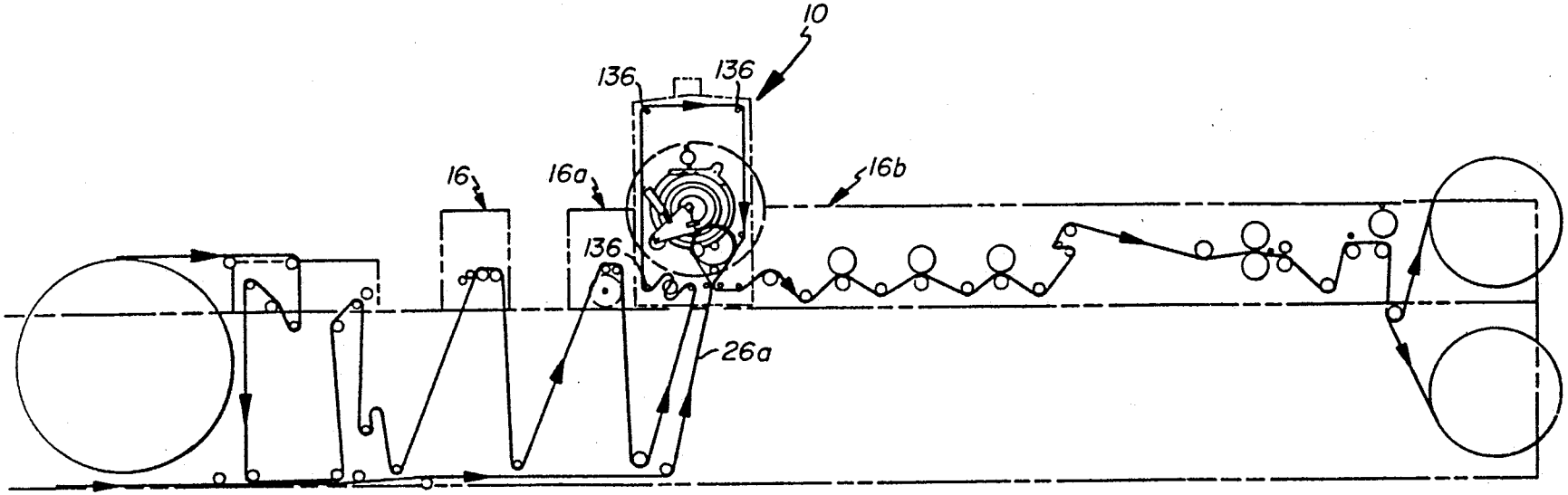
Figure 2:
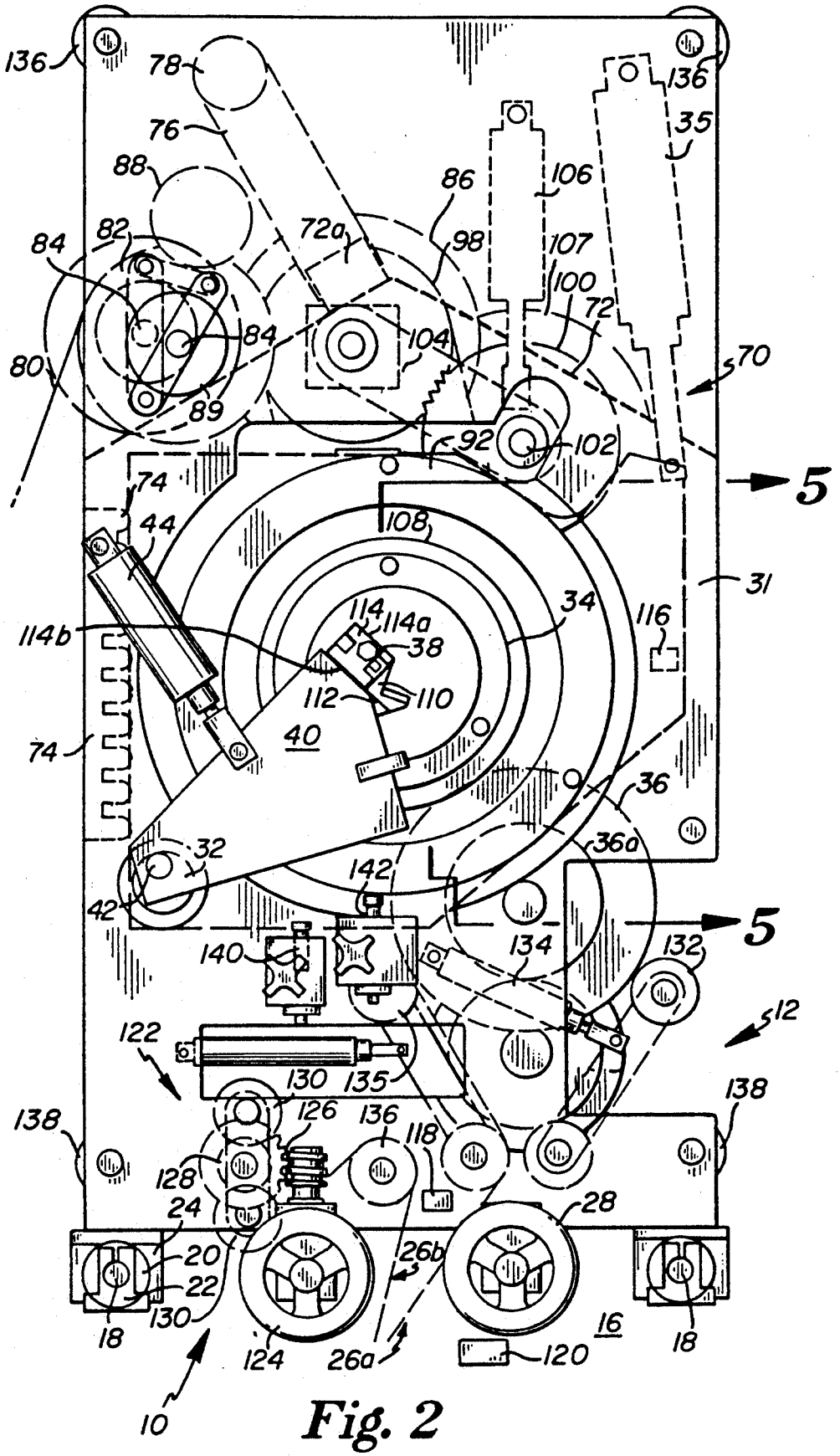
FIG. 2 is a side elevational view showing the instant invention from the outboard or operator's end.
Figure 5:
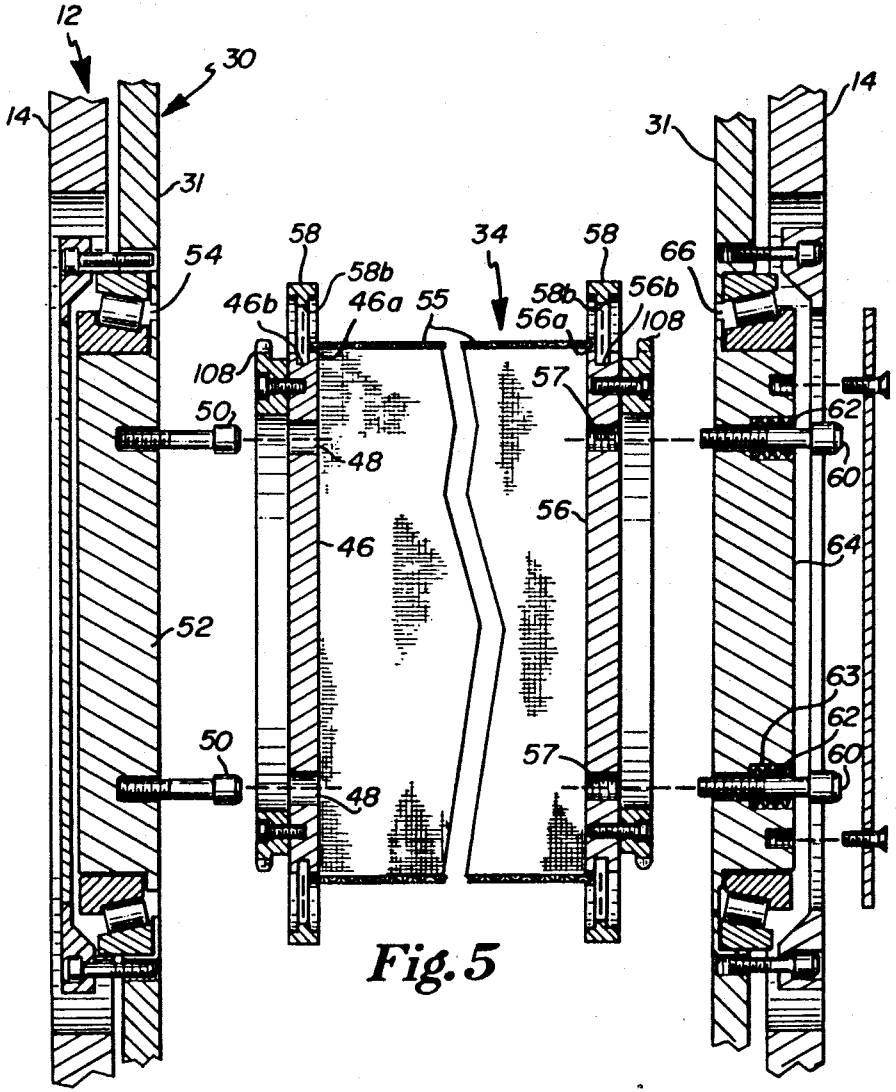
FIG. 5 is a cross-sectional view taken along line 5—5 of FIG. 2 showing the end ring and bearing attachment mechanism of the instant invention.

FIGS. 1, 2, and 5 show the rotary screen printing apparatus of the instant invention, generally designated 10. The invention includes a main frame 12, comprised of a pair of side plates 14 which are generally rectangular in shape, spaced apart and connected together by a number of rollers, tie bars and the like which will be more fully described hereinafter.

The frame 12 is mounted to a press frame 16 between the last print station **16*a* and the first die cut station 16*b* via shafts 18 which are mounted in linear bearings 20 along with mounting plates 22 and 24 attached to the press frame 16 and main frame 12 respectively. This allows the whole printing assembly 10 to be moved from side to side relative to the webs 26*a* and 26*b* by means of screw wheel 28 providing ease of lateral registration of the screen printing apparatus relative to the webs 26*a* and 26*b***.

Figure 4:
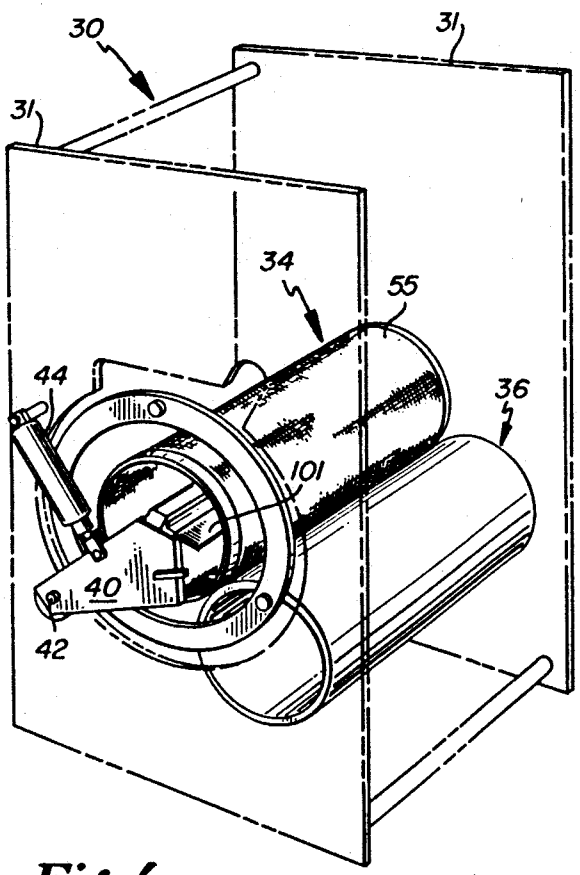
FIG. 4 is a perspective view of the pivoting screen and pressure bar assemblies.

A mounting frame 30 (see FIGS. 2, 4, and 5) is comprised of two plates 31 which are parallel and closely located just inside main frame side plates 14 and are pivotably mounted around mounting member 32 between the side plates. Mounting frame 30 may be moved up and down by means of pneumatic cylinders 35, the position being shown in FIG. 1 being that wherein the print cylinder 34 is engaged with the impression cylinder 36. The lower adjustment for the height of mounting frame 30 is formed by two lead screw/worm gear adjusters 140 located on each side plate 14 and tied together with a rod such that both may be adjusted simultaneously from the operator's side (the side shown in FIGS. 1 and 2—the other side is known as the machine side).

A pressure bar assembly 38 is attached to a pair of pressure bar mounting arms 40 which in turn pivot about an eccentric mounting point 42 located in the end of mounting member 32. By means of conventional clamping devices, the eccentric point 42 may be varied by rotating member 32 so as to change the relationship of the contact point between pressure bar assembly 38, print screen assembly 34 and impression roll 36. When the size of the print screen assembly 34 is changed, that changes the point of tangency between it and impression roll 36 and it is desired to maintain the pressure bar point of contact at the point of coincidence between print screen assembly 34 and impression roll 36. This arrangement allows ease of adjustment after screen changes.

Pressure bar assembly 38 may be raised and lowered in and out of position by means of air cylinders 44 attached to arms 40. The lower adjustment for the height of pressure bar assembly 38 is formed by two lead screw/worm gear adjusters 142 located on each side plate 14 and tied together with a rod such that both may be adjusted simultaneously from the operator's side.

Figure 6:
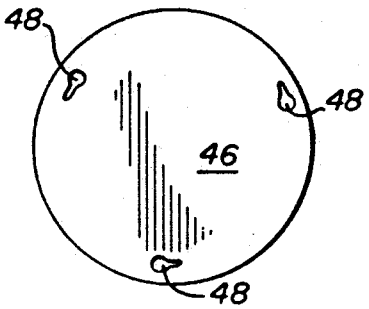
FIG. 6 is a side elevational showing the bayonet holes of the attachment mechanism of the instant invention.
Figure 7:
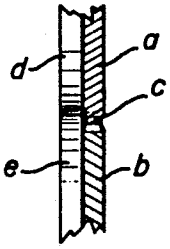
FIG. 7 shows the gears and bear plates of the instant invention.

As shown in FIGS. 5–7, the inboard or machine side, that is, the side in the back of FIG. 2, the inboard end ring 46 of print screen assembly 34 mounts via a bayonet fitting comprising keyhole shaped holes 48 to mounting pins 50 which are attached to the major idler 52 forming inner race of inboard bearing 54.

The outer end ring 56 has a plurality of threaded holes 57 into which are threaded bolts 60 which are in turn tensioned by means of springs 62 located in recesses 63 in major idler 64 which in turn forms the removable inner race of outboard end bearing 66.

Each of the end rings 46 and 56 have an outer circumference 46*a* and 56*a* respectively which in turn have grooves therein 46*b* and 56*b* respectively. Located around the outside of the end rings 46 and 56 are clamp rings 58 which may be split and secured together by screws or the like and which have ribs 58*b* extending radially inwardly therefrom. The cylindrical print screen 55 is clamped between the clamp ring 58 and the end ring 46 or 56. This highly effective means of securing the screen to the end rings allows a substantial axial tension to be placed upon the screen thereby leading to improved operation. In the preferred embodiment, end rings 46 and 56 are coated with a release coating such as DuPont's TEFLON® brand polytetrafluoroethylene.

A combination hood and heating assembly 70 is provided and is formed of a sheet metal enclosure 72 extending between side plates 14 of frame 12 and has an infrared heater 74 attached at one side thereof to heat the screen assembly 34. Due to the construction of the side plates 14 in frame 12, the area beneath the hood assembly 70 is easily heated and also serves to enclose the area where fumes from the adhesive or other material being applied may accumulate. A conduit 76 is attached to the top 72*a* of hood 72 and thereby attached to an aperture 78 in the side plate 14 of frame 12 for connection to outside exhaust.

Referring to FIG. 2, the screen printing apparatus of the instant invention is driven by a belt or chain 80 attached to the press in which the device will be mounted. This in turn drives a gear 82 which is mounted on a swingable mounting shaft 84 moveable between first and second positions whereby when gear 82 is in the right hand (or first) position shown in FIG. 2, gear 89 also attached to shaft 84 directly drives drive gear 86.

When it is desired to reverse the rotation of the machine, assembly gear 82, 89 and shaft 84 are swung to the left hand or second position shown in FIG. 2 and idler gear 88 is moved downwardly to serve as an intermediate gear and reverse the direction of drive. That is, for reverse drive, gear 89 drives idler gear 88 which in turn drives gear 86.

Figure 3:
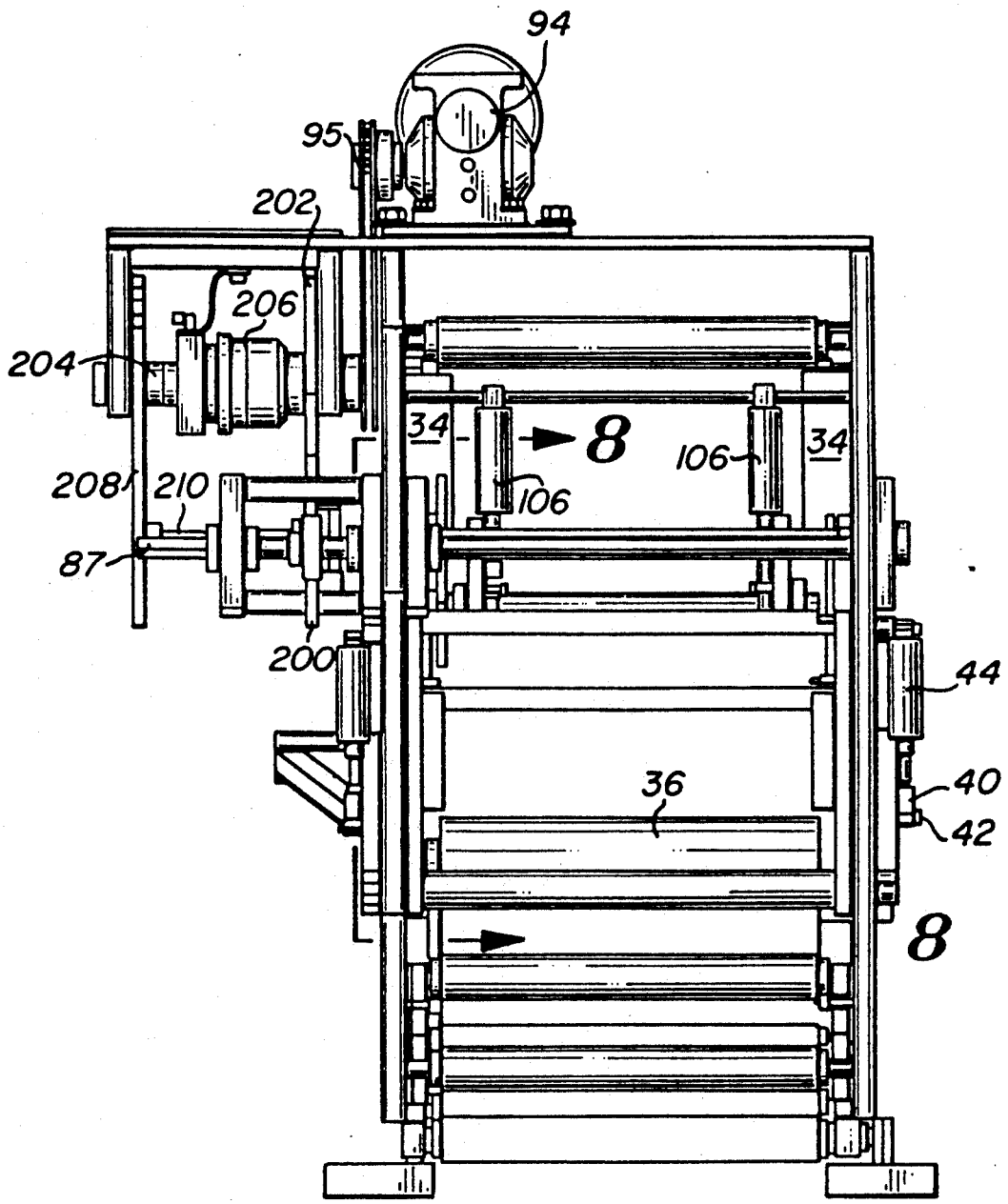
FIG. 3 is an end view of the instant invention.

As shown particularly in FIG. 3, the output from gear 86 passes through shaft 87 (shown best in FIG. 3) to gear 200 which in turn drives gear 202. Sunday drive motor 94 drives through a chain 95 into a shaft 204 which runs through the center of energizable clutch 206. When clutch 206 is not energized, Sunday drive motor 94 drives directly through shaft 204 to chain 208 which in turn drives shaft 210. When clutch 206 is energized, power is transmitted through gears 200 and 202 and that power is in turn transmitted through clutch 206 to shaft 204. At this point, Sunday drive motor 94 may either be turned off or left energized as the press drive inputting through shaft 87 in effect overruns Sunday drive motor 94.

A gear, not shown, drives through a chain, also not shown, an impression roll drive gear 92 which in turn drives impression roll 36 through gear 36*a* thereon. Gear 98 engages gear 100 which is mounted upon a shaft 102 which is in turn mounted on a swingable bracket 104 which may be moved up or down by means of pneumatic cylinders 106. When in the position shown in FIG. 2, drive forces are transmitted from gear 98 through gear 100 and thence to gear 107 which in turn drives gear 108 which is attached to print cylinder 34. When it is desired not to have print cylinder assembly 34 driven, pneumatic cylinder 106 is retracted thereby lifting gears 100 and 107 upwardly out of engagement with the print cylinder assembly 34.

Particularly where gears will be engaged and disengaged and subject to varying sized print cylinders, the use of bear wheels, a reasonably well known technique, is utilized to insure proper gear mesh and tension. As shown in brief detail in FIG. 7, the bear wheels which may be utilized are no more than disks which are attached to the respective gears meshing. A first gear a meshes with a second gear b at a tooth meshing area c. A concentric disk d is attached to gear a and a similar concentric disk e is attached to gear b such that the outer circumferences of the disks abut each other and control the depth of the meshing area c between the two gears.

The pressure bar assembly 38 is comprised of pressure bar member 110, back up plate 112 and pressure bar 114. As can be appreciated from FIG. 2, pressure bar member 110 and plate 112 may be reversed to be located on the opposite side of bar 114 at 114*a* from the side 114*b* on which it is shown mounted in FIG. 2. Because of the symmetrical arrangement, it is easy to reverse the rotation of the machine if it is desired for a particular job along with reverse drive mechanism noted above.

Re-registration (of the web relative to the screen) on the machine may be accomplished in two ways. First of all, it may be accomplished electronically using sensors 116 and 118 along with a control unit 120. Sensor 118 senses the presence of a registration mark on web 26*a* or 26*b* while sensor 116 senses the position of the print cylinder assembly 34. When the two have reached the desired location relative to one another, the clutch 206 is energized thereby allowing precise registration. This mechanism allows registration to be maintained with the rest of the web in the press without having to tie into or otherwise utilize information or signals from the press itself thereby ensuring ease of installation and integration.

Registration adjustments may also be accomplished on the fly using the mechanical registration adjustment assembly 122. A handle 124 drives a pair of gears 126 which in turn rotate a dual roller assembly 128 having rollers 130 attached at the end thereof. It can be appreciated that by rotating this assembly, the length of the web path may be increased or decreased thereby allowing a change in the relative position of the web and the print cylinder assembly 34.

The instant invention is also highly suited to indirect printing for use on temperature (or otherwise) sensitive substrates. In particular, in this arrangement a release web is fed in the path shown by web 26*b* around the outside of the machine. In an illustrative example, the material to be printed is a pressure sensitive hot melt adhesive sold by H. B. Fuller. The pattern is printed by screen assembly 34 directly on to impression roll 36 which is coated, in the preferred embodiment, with silicone rubber. In the example below, impression roll 36 was coated with a Plasma Coatings Incorporated PC915 coating.

The pattern is then carried clockwise around impression cylinder 36 where it contacts web 26b at nip roll 132. With appropriate pressure placed on nip roll 132 by pneumatic cylinder 134, the pattern is transferred to release liner web 26b. As mentioned previously, this process of offset printing of hot melt adhesive is particularly suited to temperature sensitive substrates.

By way of example, a white polyethylene or blue polypropylene release liner is capable of being printed using this technique where the adhesive temperature upon application to the impression roll is approximately 350° F. The adhesive cools (on the order of 100°-150° F.) rapidly enough during the short transition period around impression roll 36 that it is able to be applied to the polyethylene or polypropylene web without damage to the web.

The instant invention is also provided with a number of other features making it suitable for ease of application into an existing press and for ease of setup. In addition to nip roll 132, a pacer roll 135 is provided on the opposite side of impression roll 36. The roles of rolls 132 and 134 are reversed when the direction of the web through the machine is reversed. A spreader roll 138 is incorporated to further assist in predictable web handling. Various other rollers 136 are included to facilitate various web paths as desired.

The general operation of the machine is quite simple and in fact is similar to previous prior art machines. In actual change-over between various configurations, the machine excels in its ease of use. In particular, the mounting frame assembly and various pivots points allow a high degree of precision and repeatability such that improved pattern results are achieved.

For instance, when it is desired to change the print screen assembly 34 either to provide a different pattern or different sized pattern, the clutch 206 is activated thereby disengaging drive to print cylinder 35. Pneumatic cylinders 34 are energized thereby lifting mounting frame 30 upwardly thereby removing screen 55 from contact with impression roll 36. Pneumatic cylinder 106 is thence retracted thereby lifting gear 107 from print cylinder gear 108.

Figure 8:
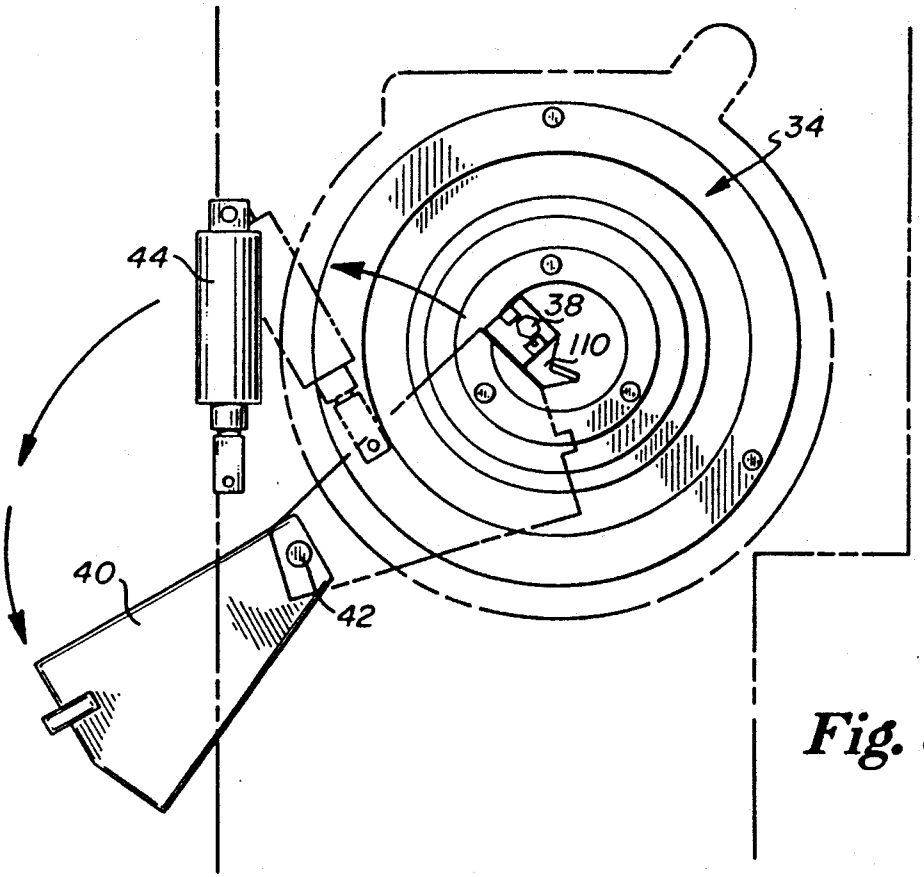
FIG. 8 is a cross-sectional view taken along line 8—8 showing the pressure bar attachment mechanism during disassembly of the instant invention.

Pressure bar assembly 38 is then unbolted from the outer mounting bracket 40 which has previously been swung upwardly by pneumatic cylinder 44. The outer pneumatic cylinder 44 is then allowed to be unbolted at its lower end and bracket 40 swung downwardly out of the way as shown in FIG. 8. The tension on screen 55 is then removed by loosening bolts 60 thereby releasing the tension caused by springs 62. After bolts 60 are removed, the outside major idler 64 is removed and the end ring 46 grasped and rotated to disconnect the bayonet fittings 48 therein and allowing the screen assembly 34 to be withdrawn from the operator side of the machine. When it is desired to reassemble the machine, the above process is reversed.

It is contemplated that various changes and modifications may be made to the rotary screen printing apparatus without departing from the spirit and scope of the invention as defined by the following claims.

What is claimed is:

1. A screen printing apparatus for accommodating screens of varying diameters, comprising:

a cylindrical printing screen having a longitudinal axis, a predetermined outer peripheral surface, and a predetermined inner peripheral surface;

a main frame;

a screen mounting frame pivotably mounted upon said main frame by means of a mounting member, having a longitudinal axis disposed parallel to said longitudinal axis of said cylindrical printing screen and disposed externally of said predetermined outer peripheral surface of said cylindrical printing screen, said cylindrical printing screen being rotatably mounted within said screen mounting frame;

an impression roll rotatably mounted within said main frame for rotational contact with said cylindrical printing screen;

a pressure bar; and pressure bar mounting means for mounting said pressure bar such that said pressure bar is disposed within said cylindrical printing screen, said pressure bar mounting means being pivotably mounted upon said mounting member disposed externally of said predetermined outer peripheral surface of said cylindrical printing screen so as to permit said pressure bar to engage said predetermined inner peripheral surface of said cylindrical printing screen at the point of tangency defined between said cylindrical printing screen and said impression roll even when different sized printing screens are utilized.

2. Apparatus as set forth in claim 1, further comprising:

means for movably mounting said screen mounting frame upon said main frame so as to move said cylindrical printing screen into and out of peripheral engagement with said impression roll.

3. Apparatus as set forth in claim 2, wherein:

said means for movably mounting said screen mounting frame comprises a plurality of pneumatic cylinders.

4. Apparatus as set forth in claim 1, wherein:

said pressure bar mounting means comprises a pair of pressure bar mounting arms having said pressure bar fixedly mounted upon respective one ends thereof while respective second ends thereof are eccentrically mounted upon said mounting member.

5. Apparatus as set forth in claim 4, further comprising:

means for movably mounting said pair of pressure bar mounting arms for, in turn, moving said pressure bar relative to said inner peripheral surface of said cylindrical printing screen.

6. Apparatus as set forth in claim 5, wherein:

said means for movably mounting said pair of pressure bar mounting arms comprises a plurality of air cylinders.

7. Apparatus as set forth in claim 1, wherein:

said screen mounting frame comprises a pair of laterally spaced mounting plates within which opposite ends of said cylindrical printing screen are rotatably mounted.

* * * * *